United States Patent [19]

Bogaty

[11] Patent Number: 4,878,300

[45] Date of Patent: Nov. 7, 1989

[54] ATHLETIC SHOE

[75] Inventor: Robert D. Bogaty, Scituate, Mass.

[73] Assignee: Tretorn AB, Helsingborg, Sweden

[21] Appl. No.: 219,414

[22] Filed: Jul. 15, 1988

[51] Int. Cl.[4] ..... A43B 21/26

[52] U.S. Cl. ..... 36/35 R; 36/28; 36/30 R; 36/114; 36/129

[58] Field of Search ..... 36/27, 7.8, 28, 30 R, 36/32 R, 35 B, 35 R, 37, 102, 103, 114, 129

[56] References Cited

U.S. PATENT DOCUMENTS

| | | | |
|---|---|---|---|
| 1,278,320 | 9/1918 | Ellithorpe | 36/35 B |
| 4,271,607 | 6/1981 | Funck | 36/30 R |
| 4,494,321 | 1/1985 | Lawlor | 36/28 |
| 4,594,799 | 6/1986 | Lin | 36/114 |
| 4,715,130 | 12/1987 | Scatena | 36/28 |

FOREIGN PATENT DOCUMENTS

| | | | |
|---|---|---|---|
| 3400997 | 7/1985 | Fed. Rep. of Germany | 36/35 R |
| 2556188 | 6/1985 | France | 36/37 |
| 2173987 | 10/1986 | United Kingdom | 36/114 |

*Primary Examiner*—Werner H. Schroeder
*Assistant Examiner*—Diana L. Biefeld
*Attorney, Agent, or Firm*—Donald Brown

[57] ABSTRACT

An athletic shoe provided with a bottom structure embodying spaced, parallel midsole members, a shock-dispersing plate disposed therebetween and an outsole attached to the lower one of the midsole members, characterized in that the lowermost one of the midsole members and the outsole member contain at the heel vertical openings centered within the heel area which penetrate the layers such as to permit the shock-dispersing plate to yield in the area of the openings.

18 Claims, 2 Drawing Sheets

ATHLETIC SHOE

BACKGROUND OF THE INVENTION

It is the purpose of this invention to provide an athletic shoe of improved construction to enhance its stability, reduce midsole degradation and enhance anatomical support for the wearer's foot without making the shoe uncomfortably hard and without using any parts which reduce the foot-receiving volume of the upper. More specifically, it is the purpose of the invention to provide for substantially reducing the non-uniform midsole degradation of a slip-lasted athletic shoe without resorting to an insole board and without otherwise impairing the comfort properties of a slip-lasted athletic shoe. Additionally, the invention has for its purpose to provide a novel structure for returning impact forces to the wearer's gait cycle without subsequent decrease in overall shoe stability.

SUMMARY OF THE INVENTION

The invention as herein illustrated comprises a shoe and bottom for attachment thereto, comprising two vertically-spaced, parallel midsole layers, a shock-dispersing plate interposed between the midsole layers at the heel end and an outsole layer disposed in engagement with the underlying one of the midsole layers, characterized in that the midsole layer closest to the outsole layer and the outsole layer contain in the area of the heel center before the arch portion of the shoe openings which permit the shock-dispersing plate board in the area of the openings to yield. The openings in the underlying one of the midsole layers and the outsole layer are optionally of circular configuration, elliptical configuration or pear-shaped configuration and, desirably, the openings are located substantially midway between the backline of the heel and the breastline of the heel and substantially midway between the opposite sides of the heel. In another embodiment, the underlying one of the midsole layers may contain an opening exclusively of the outsole layer. The opening may be formed partway or all the way through the midsole layer. The shock-dispersing layer is incompressible, is transversely and longitudinally resistant to extension, is transversely relatively stiff and is longitudinally relatively flexible. The plate and midsole arrangement without the openings as described in this invention were sold as part of shoes for more than a year prior to this application by Etonic, e.g., in the Etonic Quasar running shoe.

BRIEF DESCRIPTION OF THE DRAWINGS

Referring to FIG. 1, there is shown in elevation an athletic shoe comprising an upper 10 and a bottom 12. The upper 10 may be comprised of fabric, leather or a combination thereof and is of conventional construction. Bottom 12 is of multi-layer construction comprising an inner midsole 14, an outer midsole 16, a shock-dispersing plate 18 disposed between the midsoles 14 and 16, and an outsole 20. The midsoles and outsole are coextensive from the heel end to the toe end and preferably are of a foam plastic material, e.g., EVA. The shock-dispersing plate 18 extends from the heel end forwardly to approximately the ball of the foot. The plate 18 may have the same rear configurement as the midsoles and be coextensive as shown in FIGS. 1 and 2 or may be inward from the surface outside exposed surfaces of the midsoles as shown in FIGS. 1 and 2 as long as it performs the function as described herein under the heel of the user. The plate may be of a fiberglass material with the fiberglass fibers preferably being in an interweaved crossing pattern and interlaced pattern. The plate is made from, for example, a composite of polyester resin containing woven or chopped fiberglass, e.g., with 25% resin.

The several layers 14, 16, 18 and 20 are adhesively integrated (i.e., coupled together).

Figure 1:
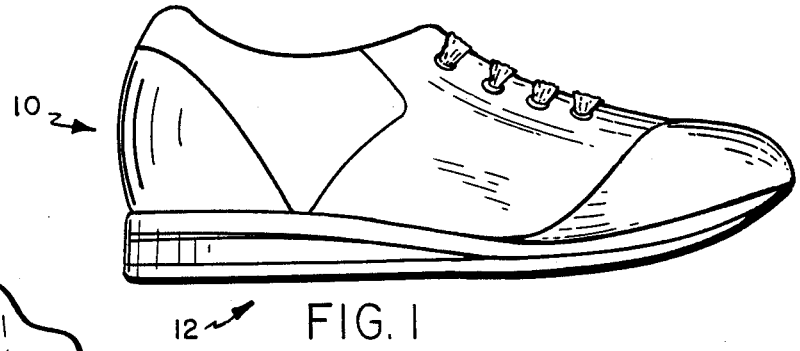
FIG. 1 is a side elevation of an athletic shoe made according to this invention.
Figure 2:
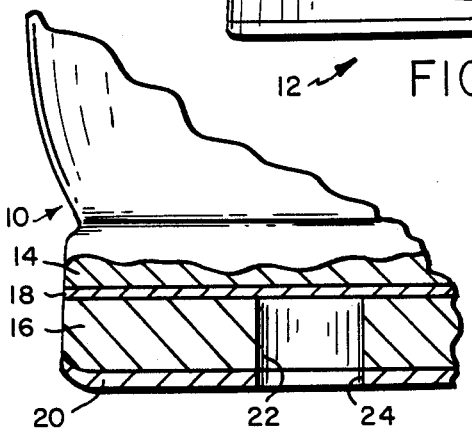
FIG. 2 is a fragmentary vertical section taken longitudinally of the shoe at the heel end.
Figure 3:
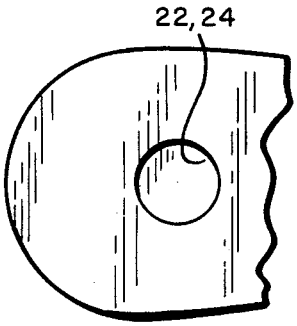
FIG. 3 is a fragmentary bottom view of FIG. 1 showing an opening at the heel end most preferably configured for running.
Figure 4:
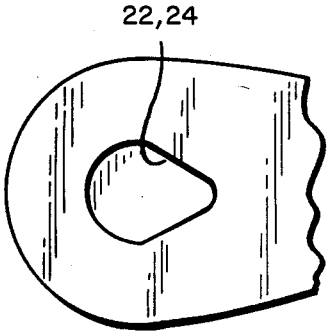
FIG. 4 is a fragmentary bottom view showing an opening preferably configured for basketball.
Figure 5:
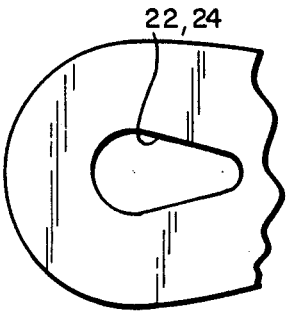
FIG. 5 is a fragmentary bottom view showing an opening preferably configured for training.
Figure 6:
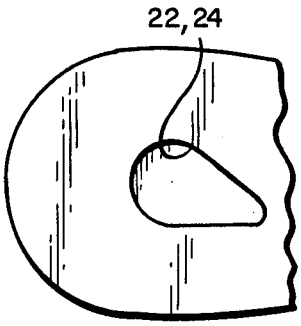
FIG. 6 is a fragmentary bottom view showing an opening configured also preferred for running.
Figure 7:
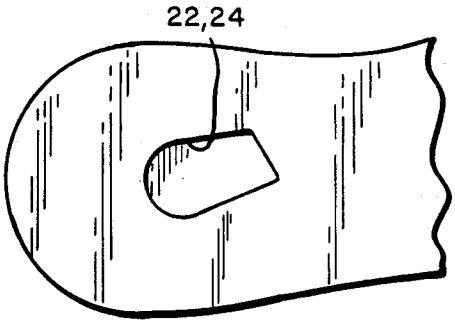
FIG. 7 is a fragmentary bottom view showing an opening preferably configured for tennis.
Figure 7A:
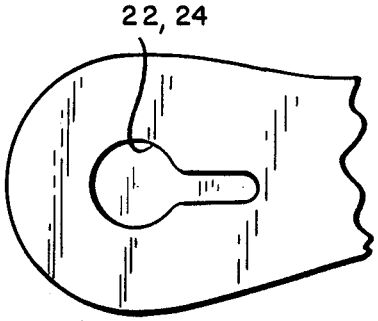
FIG. 7A is a bottom view showing yet another construction.

In accordance with the invention, the outer one of the midsole layers 16 and the outsole 20 are provided at the heel end of the shoe with preferably substantially concentric openings 22 and 24. As shown in FIG. 3, the openings 22,24 are of circular configuration. The circular configuration of the openings is considered to be optimum for running shoes. As shown in FIG. 4, the openings are pear-shaped and symmetrically located with respect to the longitudinal center line of the shoe. Openings of this configuration are considered optimum for basketball. FIG. 5 shows openings of tear-shaped configuration which are considered optimum for training shoes. FIG. 6 shows openings of teardrop configuration considered to be optimum for running. FIG. 7 shows truncated tear-shaped openings considered to be beneficial for tennis and FIG. 7A shows a keyhole-type opening. In addition to the openings 22,24, the outsole 20 is provided with an appropriate traction tread surface, FIG. 12.

Figure 12:
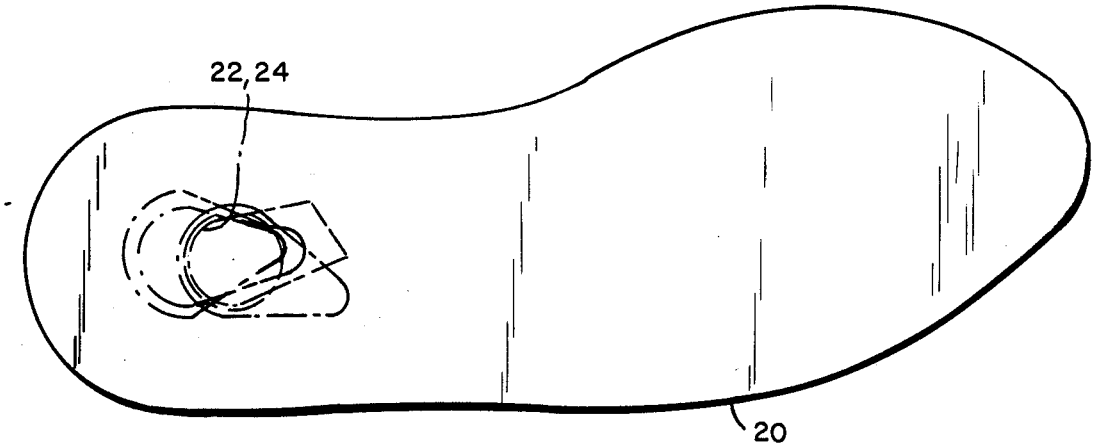
FIG. 12 is a bottom view of the outer midsole showing the disposition of the various openings in phantom in FIGS. 2 to 7.
Figure 13:
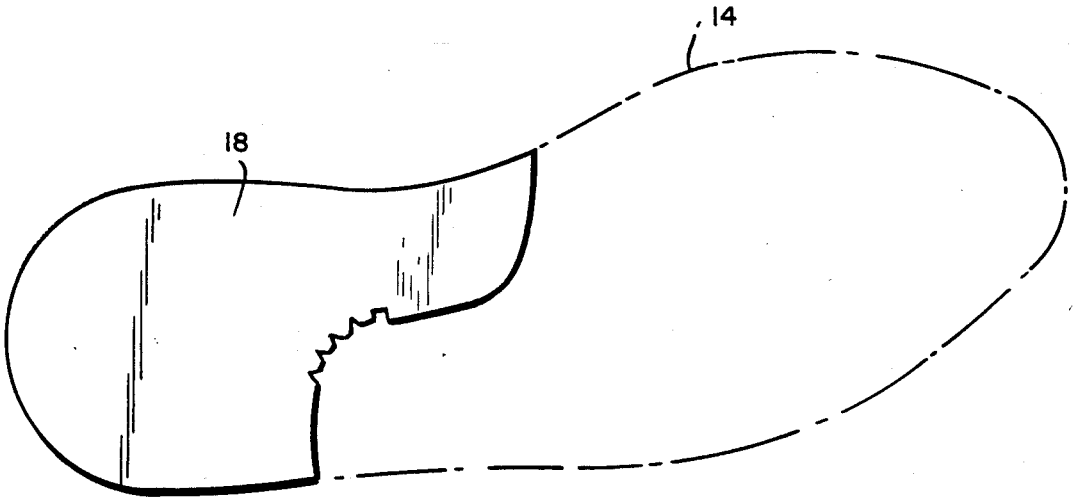
FIG. 13 is a bottom view of the inner midsole showing the disposition of the force-dispersing plate.

In each instance, FIG. 12, the openings in the lower or outer one of the midsoles 16 and the outsole 20 are located between the heel end of the bottom and ball of the shoe bottom and generally midway between the opposite sides of the bottom. The circular openings 22,24 of FIG. 3 are located at approximately the center of the heel, that is, midway between the backline and the breastline. The openings 22,24 in FIGS. 4 and 5 are located at approximately the center of the heel and extend forwardly to approximately the breastline of the heel. The openings 22,24 of FIG. 6 are oriented toward the outer side of the bottom. The openings 22,24 of FIG. 7 are truncated and oriented toward the inner side of the bottom. In FIG. 7A, the openings 22 and 24 are in the shape of a keyhole.

As has already been stated, the openings 22,24 penetrate the outsole 20 and the lower one of the midsoles 16, thus exposing the shock-dispersing plate 18 to view by one looking at the shoe bottom. Desirably, the exposed under surface of the shock-dispersing plate 18 is coated with a water-resistant layer 21, FIG. 8A.

It should be understood that while the openings 22 and 24 are preferably concentric with one another, one may be larger than the other as long as the same effect is produced.

Figure 9:
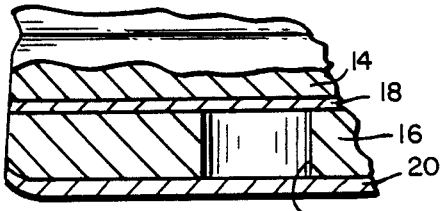
FIG. 9 shows in section a modification wherein there is an opening extending entirely through the outer midsole, but not through the outsole.
Figure 10:
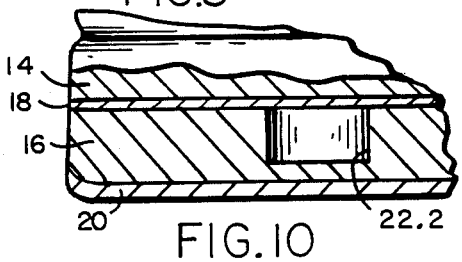
FIG. 10 shows in section a modification wherein there is an opening extending partway through the outer midsole from the upper side thereof.
Figure 11:
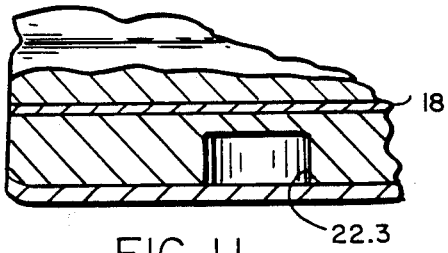
FIG. 11 shows in section a modification wherein there is an opening extending partway through the outer midsole from the lower side thereof.

In alternative embodiments, the opening in the outsole 20 may be omitted and the lower one of the midsoles provided with an openings 22-1, see FIG. 9, an opening 22-2, see FIG. 10, extending downwardly from the top side of the midsole partway through or an opening 22-3, see FIG. 11, extending from the bottom side upwardly partway through the midsole. In each instance, the opening enhances the yield of the shock-dispersing plate 18 relative to the midsole and the outsole and because of trapped air provides some repellancy to plate deflection.

In accordance with the invention, the shock-dispersing plate 18 is pre-formed so as to be relatively flexible from front to back and from side to side and is comprised of a non-compressible, non-stretchable force-dispersing plate (board) dimensioned to extend throughout and appreciably beyond the regions where major impact force concentrations usually develop under the wearer's foot at the heel end. The openings 22,24 in the midsole and/or outersole provide two benefits, to wit, (1) reduce the overall weight of the shoe and (2) allow the force-dispersing plate to deflect downwardly during impact and return to its original shape after impact. The fore to aft flexible nature of the plate enable it to act as an energy-returning device while remaining stiff enough medially and laterally to provide stability to the wearer.

Further, the plate 18 distributes the wearer's load more uniformly, causing a more uniform compression of the underlying midsole layer 16 and thus significantly reducing, if not substantially eliminating, non-uniform degradation of the underlying midsole layer. As a result, the shoe remains stable even after long usage.

Figure 8:
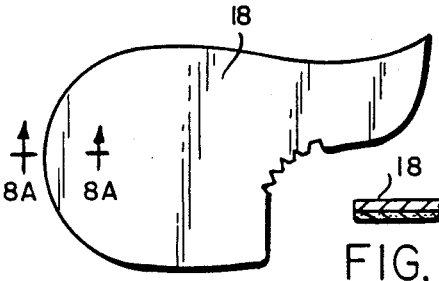
FIG. 8 is a plan view of the force-dispersing plate.
Figure 8A:
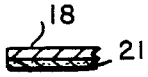
FIG. 8A is a fragmentary vertical section of the force-dispersing plate showing a water-resistant adhesive on the lower side.

As illustrated in FIG. 8, the plate 18 is configured to underlie the wearer's entire rearfoot region, that is, the heel end, and to extend forwardly approximately to the first, second and third metatarsal areas to thus underlie the inside arch, but not the outside arch of the wearer's midfoot. As a result, the plate 18 does not interfere with the required flexion of the shoe. When placed between the midsoles 14,16 it is flexible and has the capability of deflecting downwardly during impact and upwardly after the wearer begins the rolling portion of a gait cycle.

The force-dispersing plate 18 of this invention separates the middle layers at the heel end and is advantageously glued or otherwise adhered to the upper and lower midsole layers. Because the plate 18 is non-stretchable, the adherence of the plate to the opposing midsole layers by itself has the effect of constraining the outward lateral expansion of the midsole layers due to compressive forces, thereby reducing midsole degradation due to such outward expansion.

By making the force-dispersing plate 18 stiff enough to resist lateral displacement and flexible from front to back, the midsole layer 16 will act almost solely as a shock absorber to absorb forces resulting from the impact of the foot on the ground. The force-dispersing plate 18 itself, due to its fore-to-aft flexible nature, bends enough so that it distributes the impact forces uniformly and returns a portion of those forces to the wearer's propulsive forefoot activity. The midsole 14 overlying the plate 18 also absorbs the shock and additionally cushions the wearer's foot so that the shoe does not feel hard due to the presence of the plate.

Desirably, the underlying one of the inner midsole layers is approximately 12 mils thick, the outer midsole layer is approximately 15 mills thick, and the force-dispersing plate 18 is approximately 0.6 to 0.8 mils thick. The outsole layer is approximately 6 mils thick and is preferably of synthetic rubber or natural rubber.

It should be understood that the present disclosure is for the purpose of illustration only and includes all modifications or improvements which fall within the scope of the appended claims.

What is claimed:

1. A shoe bottom for attachment to the bottom side of an upper, comprising two inner and outer midsole layers, a shock-dispersing plate layer interposed between the midsole layers at the heel end and an outersole layer disposed in engagement with the underlying one of the midsole layers, said underlying one of the midsole layers and the outsole layer containing in the area of the heel center a vertical opening, said vertical openings in the underlying one of said midsole layers and said outsole layer are overlying and expose said plate layer whereby said plate layer may deflect downwardly in the area defined by the openings.

2. A shoe bottom according to claim 1, characterized in that the several layers are adhesively integrated.

3. A shoe bottom according to claim 1, characterized in that the openings are circular.

4. A shoe bottom according to claim 1, characterized in that the openings are elliptical.

5. A shoe bottom according to claim 1, characterized in that the openings are pear-shaped.

6. A shoe bottom according to claim 1, wherein the openings are located substantially midway between the backline of the heel and the breastline of the heel.

7. A shoe bottom according to claim 1, wherein the openings are located substantially midway between the opposite sides of the heel.

8. A shoe bottom according to claim 1, wherein the midsole layers are of a foam plastic material.

9. A shoe bottom according to claim 1, characterized in that the outsole layer is comprised of synthetic rubber.

10. An athletic shoe, comprising an upper and a shoe bottom attached thereto, said shoe bottom comprising an inner and outer midsole, a shock-dispersing plate layer interposed between the midsole layers at the heel end and an outer sole layer disposed in engagement with the outer of the midsole layers, said outer one of the midsole layers and the outsole layer contain in the area of the heel a vertical opening, said vertical opening in the outer of said midsole layers and said outsole layer are overlying and expose said plate layer whereby said plate layer may deflect downwardly in the area defined by the openings.

11. A shoe bottom according to claims 1 or 10, wherein the shock-dispersing plate layer is transversely and longitudinally resistant to extension.

12. A shoe bottom according to claims 1 or 10, wherein the shock-dispersing plate layer is adhesively attached to the midsoles.

13. A midsole for incorporation in the shoe bottom comprising two midsole layers and a shock-dispersing plate layer disposed between the midsole layers at the heal end, one of said midsole layers defining an opening, said opening exposing a portion of said plate whereby said plate may deflect downwardly in the area defined by said opening.

14. A midsole according to claim 13 characterized in that the layers are integrated.

15. A midsole according to claim 13, characterized in that the shock-dispersing plate layer exposed within the opening is coated with a protective layer.

16. A midsole according to claim 13, characterized in that the shock-dispersing plate layer is transversely relatively stiff.

17. A midsole according to claim 13, wherein the shock-dispersing layer is longitudinally relatively flexible.

18. A midsole according to claim 13, wherein the shock-dispersing layer is substantially non-yieldable in the longitudinal direction.

* * * * *